US008381893B2

(12) United States Patent
Trenner et al.

(10) Patent No.: US 8,381,893 B2
(45) Date of Patent: Feb. 26, 2013

(54) INSERTION DEVICE FOR COINS

(75) Inventors: Christian Trenner, Berlin (DE); Andreas Fresenborg, Kleinmachnow (DE)

(73) Assignee: Walter Hanke Mechanische Werkstatten GmbH & Co. KG (DE)

( * ) Notice: Subject to any disclaimer, the term of this patent is extended or adjusted under 35 U.S.C. 154(b) by 32 days.

(21) Appl. No.: 12/919,135

(22) PCT Filed: Feb. 25, 2009

(86) PCT No.: PCT/EP2009/001583

§ 371 (c)(1), (2), (4) Date: Nov. 29, 2010

(87) PCT Pub. No.: WO2009/106364

PCT Pub. Date: Sep. 3, 2009

(65) Prior Publication Data

US 2011/0130084 A1 Jun. 2, 2011

(30) Foreign Application Priority Data

Feb. 25, 2008 (DE) ..... 10 2008 010 848

(51) Int. Cl.
*G07F 1/04* (2006.01)

(52) U.S. Cl. ..... 194/347; 194/321; 194/345; 194/346; 194/312; 453/12; 453/49; 453/57

(58) Field of Classification Search ..... 194/321–323, 194/345–349, 232–236, 249–258, 288, 289, 194/292, 295–299, 308–315; 453/6, 10, 453/12, 49, 57

See application file for complete search history.

(56) References Cited

U.S. PATENT DOCUMENTS

| | | | | | |
|---|---|---|---|---|---|
| 4,842,120 | A | * | 6/1989 | Dobbins et al. | 194/349 |
| 5,088,587 | A | * | 2/1992 | Goodrich et al. | 194/345 |
| 5,404,986 | A | * | 4/1995 | Hossfield et al. | 194/317 |
| 5,429,222 | A | * | 7/1995 | Delay | 194/343 |
| 5,513,738 | A | * | 5/1996 | Hird et al. | 194/345 |
| 5,573,100 | A | * | 11/1996 | Vergne et al. | 194/318 |

(Continued)

FOREIGN PATENT DOCUMENTS

| | | | |
|---|---|---|---|
| DE | 44 08 254 | A | 9/1994 |
| EP | 0 609 923 | A | 8/1994 |

(Continued)

OTHER PUBLICATIONS

"International Application No. PCT/EP2009/001583, International Search Report mailed Jun. 4, 2009", 7 pgs.

*Primary Examiner* — Jeffrey Shapiro
(74) *Attorney, Agent, or Firm* — Schwegman Lundberg & Woessner, P.A.

(57) ABSTRACT

The invention proposes an insertion device for coins for transferring said coins to a coin tester or to a coin-operated machine, having an insertion slot and having a coin outlet, between which is arranged a rotatable drum having a receiving region for receiving a coin, wherein in a receiving position, the receiving region is accessible to a coin which can be inserted through the insertion slot, and the insertion slot can be closed off by means of rotation of the drum. The drum having the receiving region is covered by a flap which can be opened in a controlled fashion in an ejection position for ejecting foreign material.

20 Claims, 5 Drawing Sheets

U.S. PATENT DOCUMENTS

Figure 1:
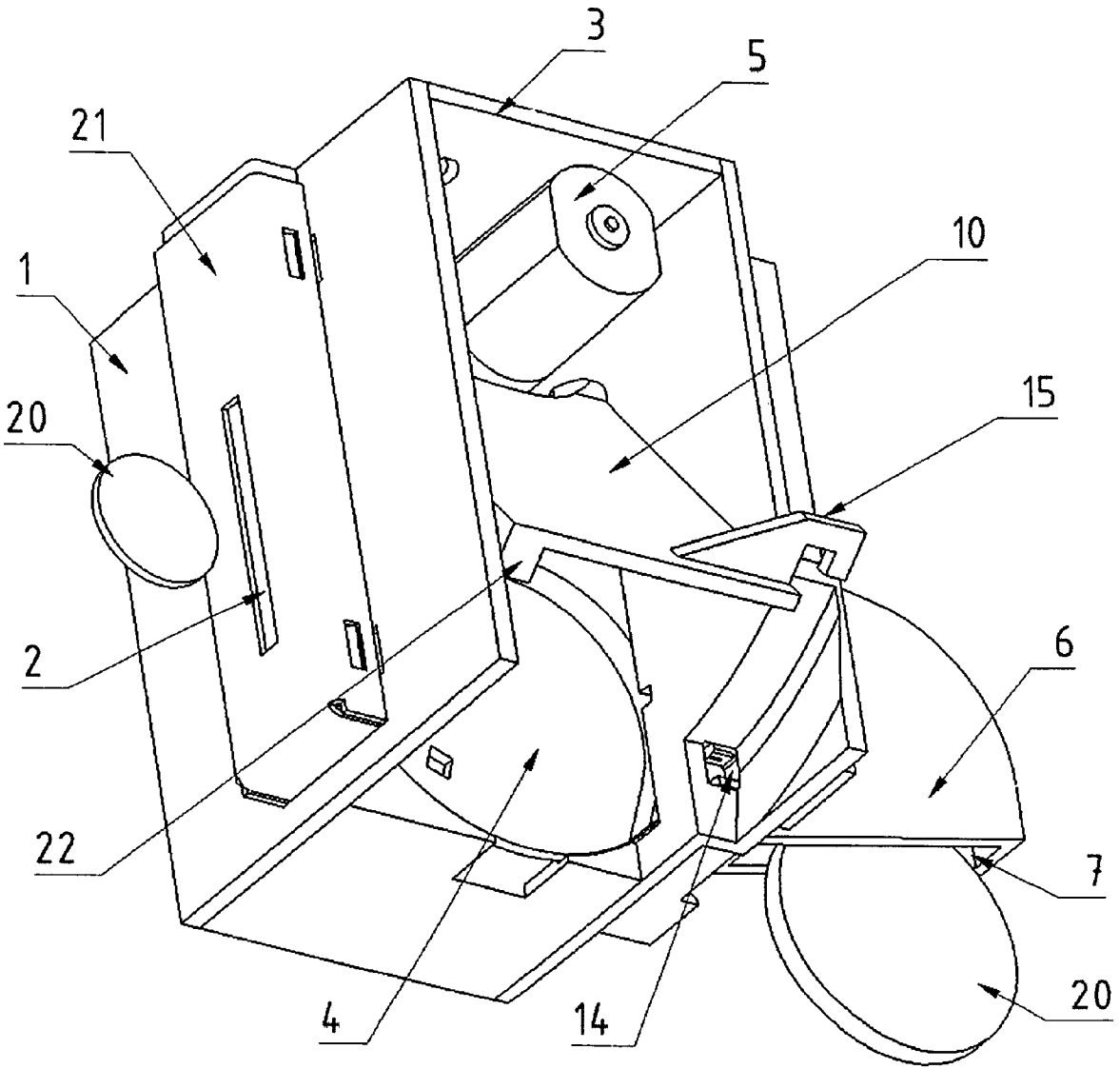

| | | | | |
|---|---|---|---|---|
| 5,596,630 | A * | 1/1997 | Hsu | 379/145 |
| 5,713,451 | A * | 2/1998 | Masse | 194/202 |
| 5,829,569 | A * | 11/1998 | Cheng et al. | 194/345 |
| 5,887,053 | A * | 3/1999 | McGough | 379/145 |
| 5,915,519 | A * | 6/1999 | Glaser | 194/345 |
| 6,050,388 | A * | 4/2000 | Gautherot | 194/317 |
| 6,786,408 | B2 * | 9/2004 | Yamagishi et al. | 235/451 |
| 7,635,059 | B1 * | 12/2009 | Bruner et al. | 194/200 |
| 7,735,622 | B2 * | 6/2010 | String | 194/347 |
| 2004/0045788 | A1 * | 3/2004 | Dobbins et al. | 194/325 |
| 2005/0224313 | A1 * | 10/2005 | Hilton et al. | 194/211 |

FOREIGN PATENT DOCUMENTS

| | | |
|---|---|---|
| WO | WO-03/056522 A1 | 7/2003 |

* cited by examiner

INSERTION DEVICE FOR COINS

PRIORITY CLAIM TO RELATED APPLICATIONS

This application is a national stage application under 35 U.S.C. §371 of PCT/EP2009/001583, filed Feb. 25, 2009, and published as WO 2009/106364 A1 on Sep. 3, 2009, which claims priority to German Application No. 10 2008 010 848.0, filed Feb. 25, 2008, which applications and publication are incorporated herein by reference and made a part hereof in their entirety, and the benefit of priority of each of which is claimed herein.

The invention relates to an insertion device for coins for transferring into a coin tester or a coin-operated machine.

Frequently coin testers are preceded by so-called slot barriers, which are situated in automatic machines, such as parking, ticket or vending machines or the like, so as to produce a certain spatial separation in order to obviate manipulation and vandalism. However, it has been shown that, due to the introduction of wire or strips of paper through the slot as far as the coin testers, the desired aim has not been achieved.

An insertion device is known from U.S. Pat. No. 5,404,986 which attempts to suppress manipulation and destruction. This device has an insertion slot, a return slot situated thereunder and a rotatable disc in which a segment is recessed for receiving coins. In the region of the housing parts surrounding the disc, sensors and detectors are provided, which test the properties of a coin received in the recessed region, for example the diameter or the alloy. In the inoperative position, the disc is disposed such that the recessed region is situated behind the insertion slot and can receive a coin. If a coin is inserted and is detected via corresponding light barriers, a motor rotates the disc by a specific angle range, it being decided, taking into account the sensor and detector signals, whether the coin should be accepted. If this is the case, the disc rotates further until the coin falls out of the recessed region into a corresponding cashbox or the like. If the coin is not accepted, then the disc rotates in the other direction until the recessed region corresponds to the return slot.

In the case of such a known device, it occurs however in addition that manipulation attempts are undertaken, for example foreign objects, such as paper, wire or the like are introduced which impair the mode of operation of the device and block the coin channels.

The object therefore underlying the invention is to produce an insertion device for coins for transferring into a coin tester or a coin-operated machine, with which device the possibility of manipulation is reduced.

This object is achieved according to the invention by the characterising features of the main claim in conjunction with the features of the preamble.

Advantageous developments and improvements are possible due to the measures indicated in the sub-claims.

As a result of the fact that the drum or disc, which has the receiving region for coins, is essentially covered by a flap which must be opened in a controlled manner in an ejection position, it is possible to eject foreign material, also compressible objects, e.g. folded or compressed paper, being able to fall out through the flap opening, which objects otherwise would not be able to be removed and would lead to blockage of the entire device. The introduction device mentioned also as slot barrier with drum has a "self-cleaning" configuration, i.e. the control unit for controlling the coin insertion and transfer process detects via sensors or the motor current of the drive motor whether foreign bodies, such as paper, card, metal sheets or the like, are present or stuck for example in the slot region or entirely or partially in the receiving region of the drum and controls the drum in its movement such that it travels several times in both directions via the ejection position, as a result of which the flap covering the drum opens wide in the direction of gravity and thus, in most cases, the foreign bodies are removed again at the bottom or, because of the movement of the drum and of the flap, through the insertion slot, to the exterior. In this way, many service occasions, in the case of which specialist personnel must go to the positions of the automatic machine in order to remove foreign bodies form the insertion device, are avoided. Furthermore, destruction to the subsequently connected coin tester is avoided.

It is particularly advantageous that the flap is connected to an opening mechanism which is configured for example as a curved path provided on the drum and as a lever arrangement connected to the flap. Due to this forced control via the curve-controlled mechanism, the flap can be opened wide during rotation of the drum without additional drives and the opening mechanism is economical to produce.

Preferably, the flap is equipped with a return spring which is under pre-tension and by means of which it can be returned to the closed position.

It is advantageous that, in the region of the insertion slot, a detection sensor is disposed for establishing the approach of a coin and, as a function of a signal of the detection sensor, the drum can be rotated from an inoperative position in which the insertion slot is closed into the receiving position. In this way, the insertion slot is always closed in the inoperative state, as a result of which the insertion or introduction of foreign objects in precisely this inoperative position is prevented. Hence, an effective slot barrier is made available.

Furthermore, position sensors for detecting the position of the drum are advantageously provided, these being configured, in an advantageous embodiment, as light barriers and/or as Hall sensor arrangements. The light barrier offers the possibility in addition of detecting objects, in particular foreign objects, which do not fall or roll out in the output position, such as e.g. paper.

Advantageously, a sensor is provided for detecting the position of the flap, which sensor can be configured for example as a bifurcated light barrier since blockages and manipulation attempts can hence be diagnosed.

Figure 2:
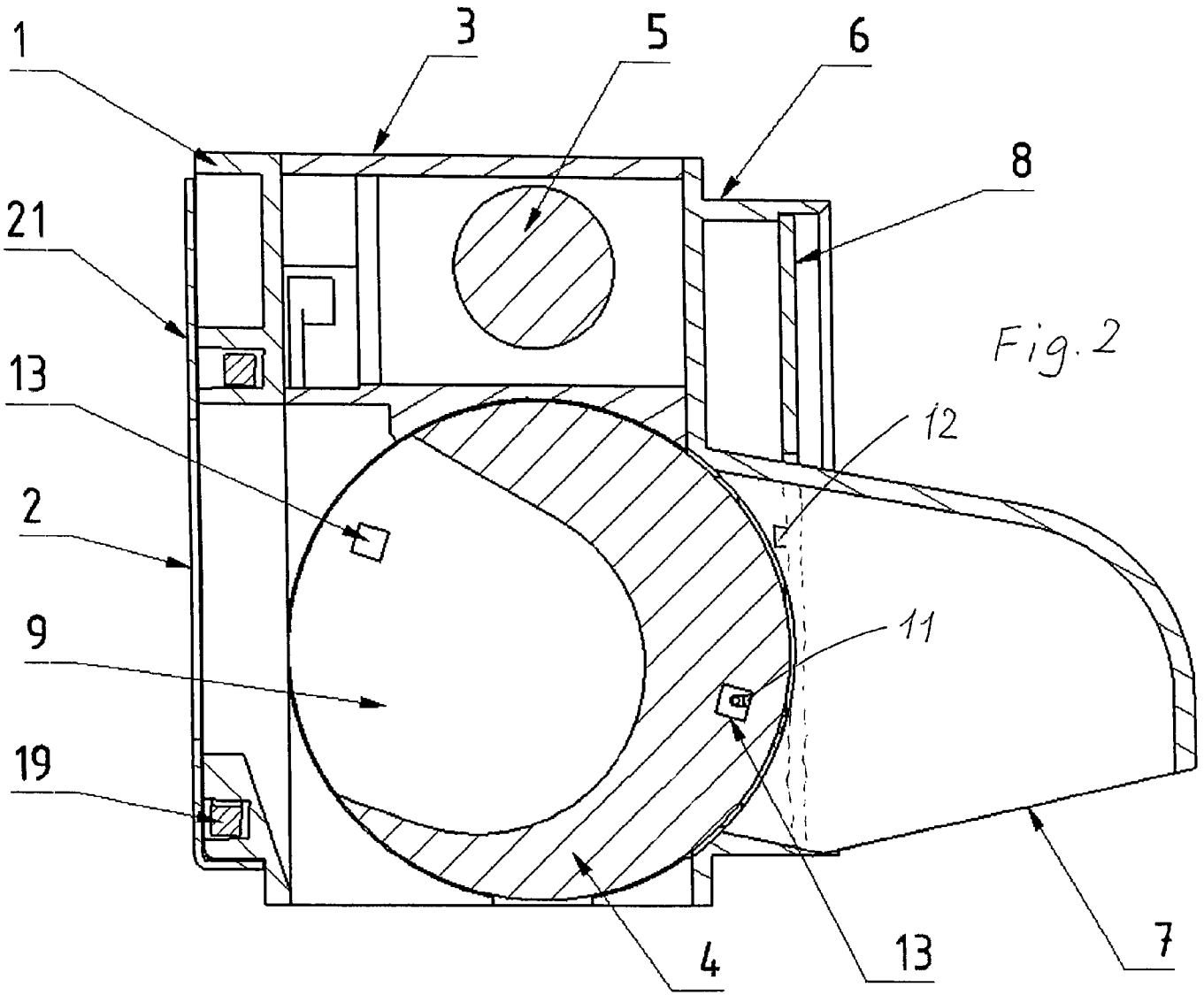
Figure 3:
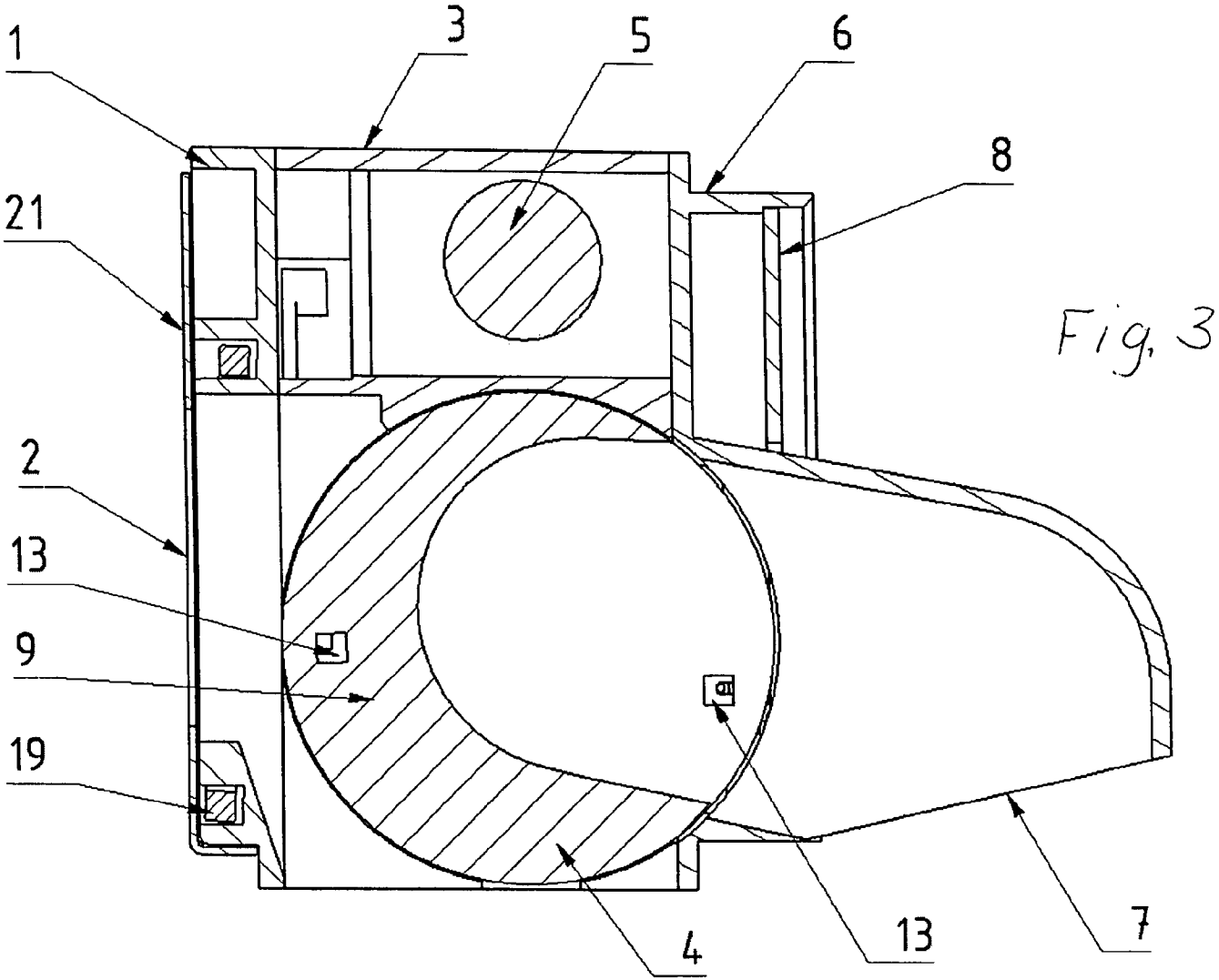
Figure 4:
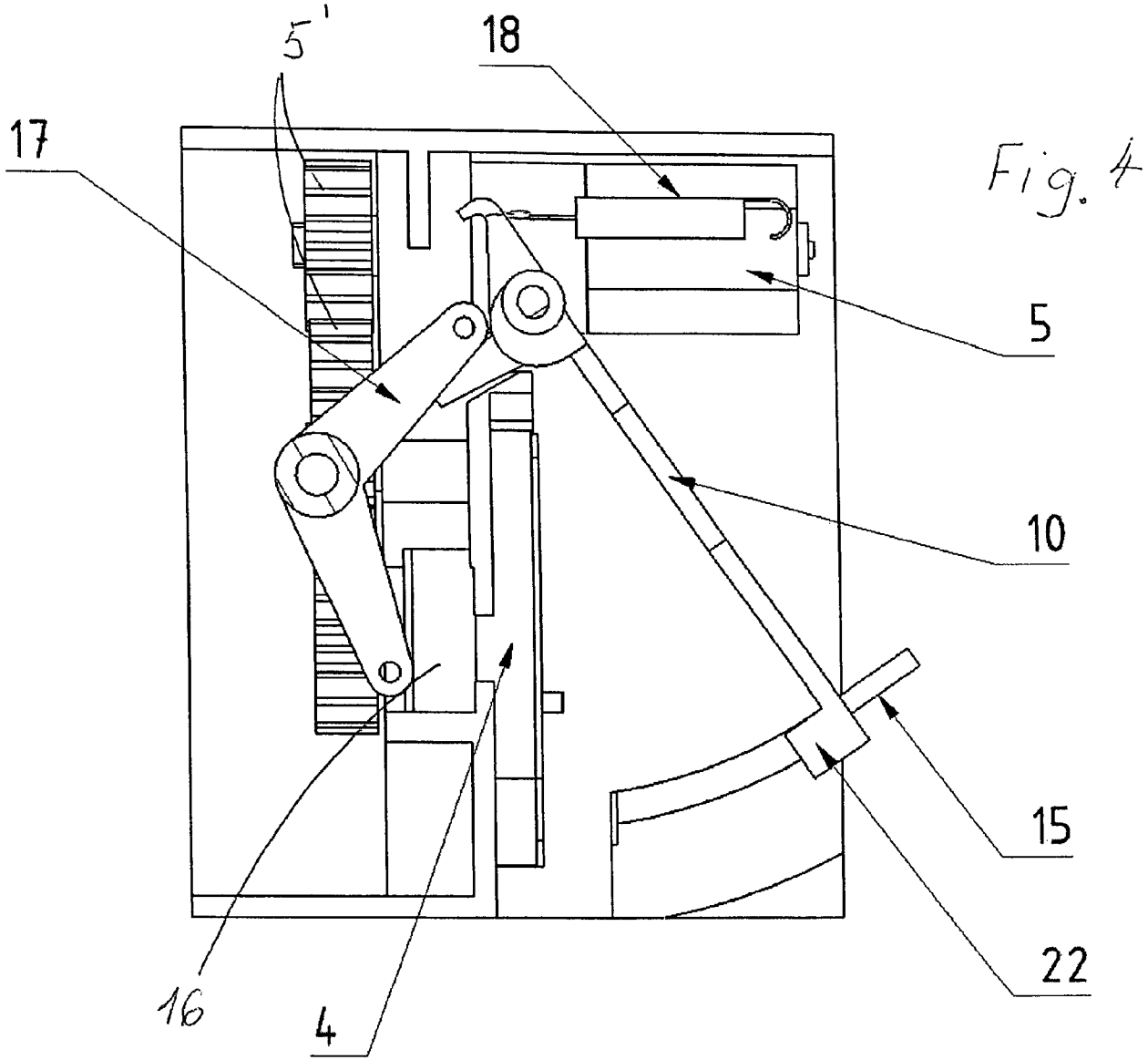
Figure 5:
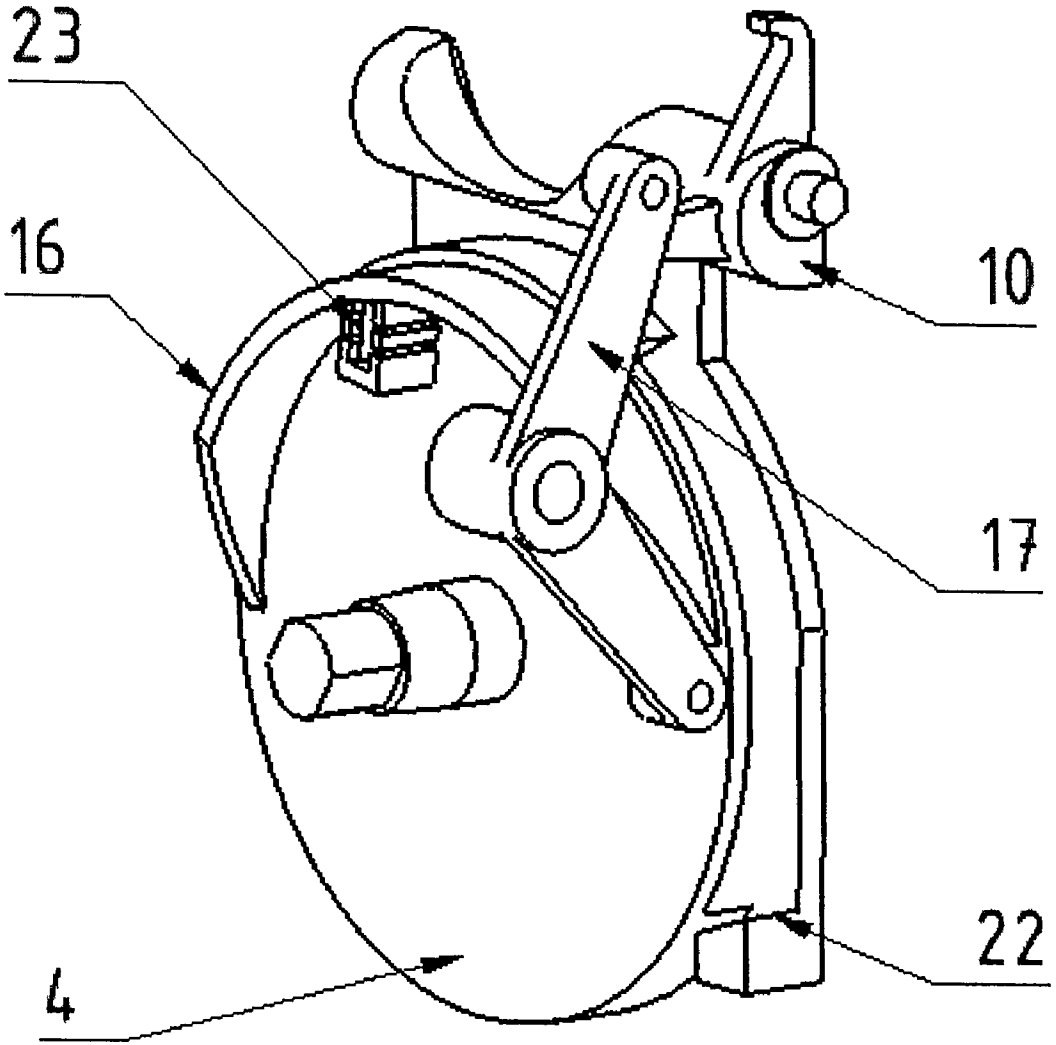

One embodiment of the invention is represented in the drawing and is explained in more detail in the subsequent description. There are shown:

FIG. 1 a perspective view of the insertion device according to the invention, FIG. 2 a sectional view of the insertion device in a plane parallel to the receiving region of the drum in the receiving position, FIG. 3 a view corresponding to FIG. 2 in the output position of the drum, FIG. 4 a view transversely relative to the drum according to an opened flap, and FIG. 5 a perspective view of the drum of the insertion device according to the invention with an opening mechanism.

The insertion device represented in FIGS. 1 to 5 has a front part 1 with coin insertion slot 2, a central part 3 on which a rotatable drum 4 is mounted and a motor 5 with a corresponding transmission 5' (see FIG. 4) are disposed, and a rear part 6 with a coin outlet 7 and a circuit board 8 with an electronic control unit for controlling the functions of the insertion device. The drum 4 has a disc-like configuration and is provided with a recess 9 which serves to receive coins of different sizes inserted via the insertion slot 2 and hence has a circular arc-shaped configuration at least in the part of the recess orientated away from the periphery of the drum 4. The drum 4 is covered by a flap 10 for the largest part thereof, as can be detected in FIG. 1 and FIG. 4, the mounting thereof being represented schematically in FIG. 5 and FIG. 6, which is provided above the drum 4 and in the region of the transmission motor 5. The flap 10 covers the drum such that a coin received in the receiving region 9, during transport thereof from the receiving position of the coins to the output position thereof at the coin outlet 7, cannot fall out, i.e. the flap 10 forms the delimiting wall of the drum 4 or of the receiving region 9 during transport of the coins.

The insertion device comprises a series of sensor arrangements. Thus, a Hall sensor 12 is disposed on the circuit board 8 (see FIG. 2), which sensor cooperates with one or more permanent magnets 23 provided on or in the drum 4 (see FIG. 5) and scans the output position of the coin at the coin outlet 7. Furthermore, light barrier elements 11 are disposed on the circuit board similarly to a bifurcated light barrier, corresponding openings 13 being provided in the receiving region 9 of the drum 4 and in the entire region of the drum over which the light barrier can extend. The one opening serves for detecting the receiving position whilst the other serves for detecting rolling out of the coin in the output position, also objects which do not roll out being detected however. Finally, another bifurcated light barrier 14 is provided, this light barrier being interrupted by an arm 15 configured on the flap 10 in the inoperative position of the flap 10. In this way, the closed position of the flap 10 can be detected.

In an ejection position of the drum 4 in which the receiving region 9 essentially points downwards, foreign bodies present in the receiving region 9 can fall out at the bottom. When moving into the ejection position, the flap 10 is actuated with forced control at the same time by an opening mechanism (see FIG. 4 and FIG. 5) which, in the present case, consists of a curved path 16, which is disposed on the rear-side of the drum 4, and also a lever mechanism 17. As a result, the flap 10 is opened wide in the ejection position (in the present case, wide means an opening angle up to 45° which is however dependent upon the available space and can be smaller, e.g. up to 30°). Furthermore, a restoring spring 18 is mounted on the flap 10, which spring is likewise mounted on the housing and returns the flap 10.

In the front part 1, a coil 19 is disposed, which coil surrounds the coin insertion slot 2 and is screened by a screening plate 21 against external disruptions. It represents a detector for coins approaching the insertion slot 2.

In FIG. 2, the coin acceptance position is represented, the flap 10 not being able to be seen here, as noted already. The drum 4 is situated in the inoperative position in a position in which the opening of the receiving region 9 points upwards to some extent such that the coin insertion slot 2 is covered by the circumference of the drum 4 and a coin 20 cannot be inserted. If a coin 20 comes into the vicinity of the slot, the detector configured as a coil 19 emits a signal to the control unit on the circuit board 8 which in turn actuates the transmission motor for moving the drum 4. The drum 4 is hence rotated, corresponding to FIG. 2, into the receiving position after detection of the coin 20, as a result of which the slot 2 is released. The coin 20 inserted through the insertion slot 2, which can have different diameters and thicknesses, rolls into the receiving region 9 which is covered by the flap 10. After introduction of the coin, the control unit controls the drum 4 or the associated motor 5 in operational connection with it for rotation thereof in the clockwise direction, as a result of which the coin insertion slot 2 is closed at the same time. After the output position is reached, the coin which has not yet been tested for its properties in the embodiment, rolls independently out of the receiving region 9 into the coin outlet 7 and is transferred for example into a coin tester or into a vending machine or the like in order to be tested. This is shown in FIG. 3, the emerging coin 20 being able to be seen in FIG. 1. This position also can be used as inoperative and starting position of the drum 4.

As stated already, the position of the drum 4 is detected via the light barrier and the Hall sensor 12. In the output position corresponding to FIG. 3 which was detected by the Hall sensor 12, the provided light barrier is used for the purpose of monitoring the coin 20 rolling out. In addition, it offers the possibility in this position of detecting objects which do not roll out, for example paper.

If the coil 19 detects a further coin to be inserted, the drum 4 is rotated further since this is the shortest path to the insertion slot 2 and moves into the ejection position. The coin receiving region 9 is thereby opened at the bottom by lifting the flap 10 from the drum 4, as a result of which any foreign objects or extraneous material possibly present can fall out, the flap 10 being opened wide by the curved path 16 on the drum rear-side connected to the lever system 17, which is represented in FIG. 1 and FIG. 4. As a result of this flap opening, also compressible objects, e.g. folded paper, fall out, which otherwise would not be able to be removed. Closure of the flap 10 is effected with actuation by a spring via the restoring spring 18. The closed position of the flap 10 is monitored via the bifurcated light barrier 15 which is fitted on the circuit board 8 with protection and is triggered by the hook or arm 15 on the flap 10. Hence blockages and manipulation attempts can be detected.

As long as a coin is not detected in the coil region, i.e. at the insertion slot 2, the drum 4 is rotated out of the output position at the coin outlet 7 in an anti-clockwise direction into the inoperative position. As stated already, the drum 4 is rotated out of the inoperative position into the coin receiving position in an anti-clockwise direction in order that the slot opening is released from the top to the bottom and the waiting coin falls into the receiving region 9 of the drum 4.

It can be detected in FIG. 1, just as in FIG. 4, that a web 22 is configured on the flap wall in the slot region such that the gap between front wall and coin drum 4 is closed. As a result, also small coins roll into the drum 4 and do not fall into the gap. With the opening of the flap 10, this region is released and does not impede ejection of foreign bodies.

If foreign bodies are introduced, which lead to locking of the rotation, the control unit stops the transmission motor 5 as a result of monitoring the motor current which increases during locking and the drum 4 is moved in the opposite direction of rotation. It is ensured by the relatively large spacing between drum edge and the lower slot edge in the front 1 that foreign bodies, which protrude somewhat out of the drum region after introduction, do not become jammed during rotation of the drum in the direction of the foreign money shaft. In particular paper is pushed back into the slot region during rotation and is pulled through the shaft between the drum and front during ejection. The control unit preferably allows a control programme to run in which the motor not only changes its direction once upon an increase in current, but a change in the direction of rotation takes place several times and hence also multiple opening of the flap 10, by means of which blockages are eliminated. Of course, this control programme of the multiple change in direction of rotation can also be implemented with corresponding flap openings if foreign bodies are detected by the light barrier(s).

In order to avoid damage to the motor, an overload coupling is provided and, upon locking of the drum 4 and too high an increase in current, is disengaged.

What is claimed is:

1. An insertion device for transferring coins into a coin tester or a coin-operated machine, the insertion device comprising:

an insertion slot;

a coin outlet;

a rotatable drum which is disposed between the insertion slot and the coin outlet, the rotatable drum including a receiving region for receiving a coin;

at least one sensor configured to detect whether a coin approaches the insertion slot and to provide a coin detection indication; and at least one additional sensor configured to detect whether a coin or an other object is contained in the received region of the drum;

wherein in a non-receiving position of the insertion device the insertion slot is closed by the drum to resist placement of the coin into the insertion slot, wherein the insertion device is configured to receive the coin detection indication and upon reception of the coin detection indication to rotate the drum to a receiving position in which the receiving region of the drum is positioned to receive the coin through the insertion slot and into a receiving region, wherein the insertion device is configured to again close the insertion slot by rotation of the rotatable drum into an output position, allowing a coin contained in the receiving region to roll out of the drum, and wherein, in case the additional sensor detects an object remaining in the drum after the output position is reached, the insertion device is configured to rotate the drum to an ejection position and controllably open a flap that covers the drum to discharge a foreign material while the drum is in the ejection position.

2. The insertion device according to claim 1 comprising a control unit, wherein the control unit is connected to a motor to actuate the rotatable drum, the control unit configured to control an insertion and transfer process of the coin.

3. The insertion device according to claim 1, wherein the flap is in operational connection with an opening mechanism for a forced control.

4. The insertion device according to claim 3, wherein the opening mechanism has at least one curved path provided on the rotatable drum and a lever arrangement cooperating with the flap.

5. The insertion device according to claim 2, wherein the control unit includes a circuit to control the motor to rotate the drum to open the flap at least once and to close the flap at least once.

6. The insertion device according to claim 2, wherein the control unit is operable to control the motor and the rotatable drum to open the flap as a function of at least one of the motor current and a sensor signal which indicates at least one of locking of the rotatable drum and the presence of foreign objects.

7. The insertion device according to claim 1, wherein the ejection position is situated between the receiving position and a coin output position in which the coin is transferred via the coin outlet.

8. The insertion device according to claim 1, wherein the flap can be moved into a closed position by a return spring.

9. The insertion device according to claim 1, wherein a sensor of the at least one sensor is disposed in the region of the insertion slot and wherein the insertion device is configured to receive the coin detection indication and rotate between an inoperative position in which the insertion slot is closed and the receiving position.

10. The insertion device according to claim 1, wherein the at least one sensor is configured to at least one of detect the position of the rotatable drum and detect at least one of a coin and another object.

11. The insertion device according to claim 10, wherein the at least one sensor is configured as one of a light barrier and a Hall sensor arrangement.

12. The insertion device according to claim 11, wherein the light barrier is disposed in the region of the receiving position and the output position.

13. The insertion device according to claim 1, wherein the at least one sensor is to detect a position of the flap.

14. An insertion device for transferring coins into a coin tester or a coin-operated machine, the insertion device comprising:

an insertion slot;

a coin outlet; and a rotatable drum which is disposed between the insertion slot and the coin outlet, the rotatable drum including a receiving region for receiving a coin; and at least one sensor configured to detect a coin in the insertion slot and to provide a coin detection indication;

an additional sensor configured to detect a foreign material in the insertion slot and to provide a foreign material indication, wherein in a non-receiving position of the insertion device the insertion slot is closed by the drum to resist placement of the coin into the insertion slot, wherein the insertion device is configured to receive the coin detection indication and upon reception of the coin detection indication to rotate the drum to a receiving position in which the receiving region of the drum is positioned to receive the coin through the insertion slot and into a receiving region, wherein the insertion device is configured to again close the insertion slot-by rotation of the rotatable drum, and wherein the insertion device is configured to receive the foreign material indication and to rotate the drum to an ejection position and controllably open a flap that covers the drum to discharge the foreign material while the drum is in the ejection position.

15. The insertion device according to claim 14, comprising a control unit, wherein the control unit is connected to a motor to actuate the rotatable drum, the control unit configured to control an insertion and transfer process of the coin.

16. The insertion device according to claim 14, wherein the flap is in operational connection with an opening mechanism for a forced control.

17. The insertion device according to claim 16, wherein the opening mechanism has at least one curved path provided on the rotatable drum and a lever arrangement cooperating with the flap.

18. The insertion device according to claim 15, wherein the control unit includes a circuit to control the motor to rotate the drum to open the flap at least once and to close the flap at least once.

19. The insertion device according to claim 15, wherein the control unit is operable to control the motor and the rotatable drum to open the flap as a function of at least one of the motor current and a sensor signal which indicates at least one of locking of the rotatable drum and the presence of foreign objects.

20. The insertion device according to claim 14, wherein the ejection position is situated between the receiving position and a coin output position in which the coin is transferred via the coin outlet.

* * * * *

UNITED STATES PATENT AND TRADEMARK OFFICE

CERTIFICATE OF CORRECTION

PATENT NO. : 8,381,893 B2
APPLICATION NO. : 12/919135
DATED : February 26, 2013
INVENTOR(S) : Trenner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 128 days.

Signed and Sealed this
First Day of September, 2015

Michelle K. Lee

Michelle K. Lee
*Director of the United States Patent and Trademark Office*